United States Patent [19]

Pate

[11] 4,453,203

[45] Jun. 5, 1984

[54] LIGHTING FIXTURE REFLECTOR

[75] Inventor: James R. Pate, Salem, Va.

[73] Assignee: Harvey Hubbell Incorporated, Orange, Conn.

[21] Appl. No.: 399,223

[22] Filed: Jul. 19, 1982

[51] Int. Cl.[3] ..... F21V 7/20

[52] U.S. Cl. ..... 362/345; 362/294; 362/298; 362/304; 362/346; 362/348; 362/350; 362/373

[58] Field of Search ..... 362/294, 298, 304, 345, 362/346, 348, 350, 373

[56] References Cited

U.S. PATENT DOCUMENTS

| | | | |
|---|---|---|---|
| 755,196 | 3/1904 | Wadsworth . | |
| 1,281,752 | 10/1918 | Bailey . | |
| 1,562,502 | 11/1925 | Gowdy . | |
| 1,698,279 | 1/1929 | Schimpff . | |
| 2,340,515 | 2/1944 | Dietrich . | |
| 2,913,570 | 11/1959 | Gough et al. | 240/3 |
| 3,102,693 | 9/1963 | Rex . | |
| 3,329,812 | 7/1967 | Harling . | |
| 3,401,258 | 9/1968 | Guth | 362/349 |
| 3,662,165 | 5/1972 | Osteen et al. | 362/348 X |
| 3,758,770 | 9/1973 | Morasz | 240/41.36 |
| 3,900,727 | 8/1975 | Hutz | 240/41.35 R |
| 3,950,638 | 4/1976 | Kent et al. | 240/41.1 |
| 4,218,727 | 8/1980 | Shemitz et al. | 362/297 |
| 4,241,393 | 12/1980 | Olson | 362/348 |
| 4,347,554 | 8/1982 | Matsushita | 362/348 X |

*Primary Examiner*—Stephen J. Lechert, Jr.
*Attorney, Agent, or Firm*—Jerry M. Presson; Walter C. Farley

[57] ABSTRACT

A reflector for use with a discharge lamp having a front section with a reflective surface which follows a surface of revolution and a rear section which is fluted. The crests and roots of the flutes lie along arcs of concentric spheres. Light from the lamp directed toward the front section is reflected out through its open end. Light directed toward the rear section is reflected by the flutes away from the arc and toward the front section, thereby avoiding increases of arc temperature.

7 Claims, 3 Drawing Figures

LIGHTING FIXTURE REFLECTOR

This invention relates to an improved reflector for a lighting fixture, and particularly to a reflector used with a discharge lamp.

BACKGROUND OF THE INVENTION

Recent luminaires employ lamps such as high pressure sodium discharge arc lamps, commonly known as HPS lamps, which are very efficient. Such lamps are designed to operate at a predetermined temperature at which the intended amount of light is produced with the desired spectral characteristics and at which the lamp has a relatively well-known life.

If the operating temperature is increased, not only is the life shortened, but other characteristics can also be changed.

Normally, lamps are used with reflectors, whether the lamps are HPS or some other type. Various kinds of reflectors have been developed to create certain effects with light and for use with certain lamp types. Several examples are found in the following U.S. patents.

| U.S. Pat. No. | Inventor |
|---|---|
| 755,196 | Wadsworth |
| 4,218,727 | Shemitz et al |
| 4,241,393 | Olson |
| 3,900,727 | Hutz |
| 1,562,502 | Gowdy |
| 2,340,515 | Dietrich |
| 1,281,752 | Bailey |
| 2,913,570 | Gough et al |
| 3,329,812 | Harling |
| 3,758,770 | Morasz |
| 1,698,279 | Schimpff |
| 3,102,693 | Rex |
| 3,950,638 | Kent et al |

As will be observed, these patents show devices having various shapes with portions following selected surfaces of revolution, some surfaces having ridges, flutes or grooves and others being smooth.

BRIEF DESCRIPTION OF THE INVENTION

It has been found that the reflective characteristics of the reflector can have a substantial impact on the operating temperature of the lamp in a lamp system when a significant proportion of the light rays from the lamp arc are allowed to reflect back to the arc, adding the reflected energy to the arc energy.

Accordingly, an object of the present invention is to provide an improved reflector which provides optimum distribution of light rays in accordance with predetermined criteria but which causes reflected rays within the reflector to miss the light source, thereby preventing undesired temperature increases.

Briefly described, the invention includes a reflector particularly for use with a high energy light source, the reflector being of the type having an open substantially circular end, a central axis and means at the other, smaller end for mounting a light source in an envelope in the reflector so that the source is on said central axis and is closer to the smaller end than to the larger open end, wherein the reflector comprises a first portion extending from said open end to a location beyond a transverse plane containing the source, said first portion having means defining a substantially smooth reflective interior surface of revolution which is symmetrical about said central axis, the transverse dimensions of said first portion decreasing in the direction of said other end; and a second portion occupying the distance between the smaller end of said first portion and said smaller end of said reflector, said second portion including means defining a plurality of flutes each having a crest lying along an arc of a great circle of a first sphere centered at said source, a root lying along an arc of a great circle of a second sphere centered at said source and having a larger diameter than said first sphere, and a reflective surface extending between said root and crest, said plurality of flutes being uniformly distributed about said central axis whereby light rays passing from said source toward said second portion are reflected toward said open end and said first portion along paths laterally offset from said source.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
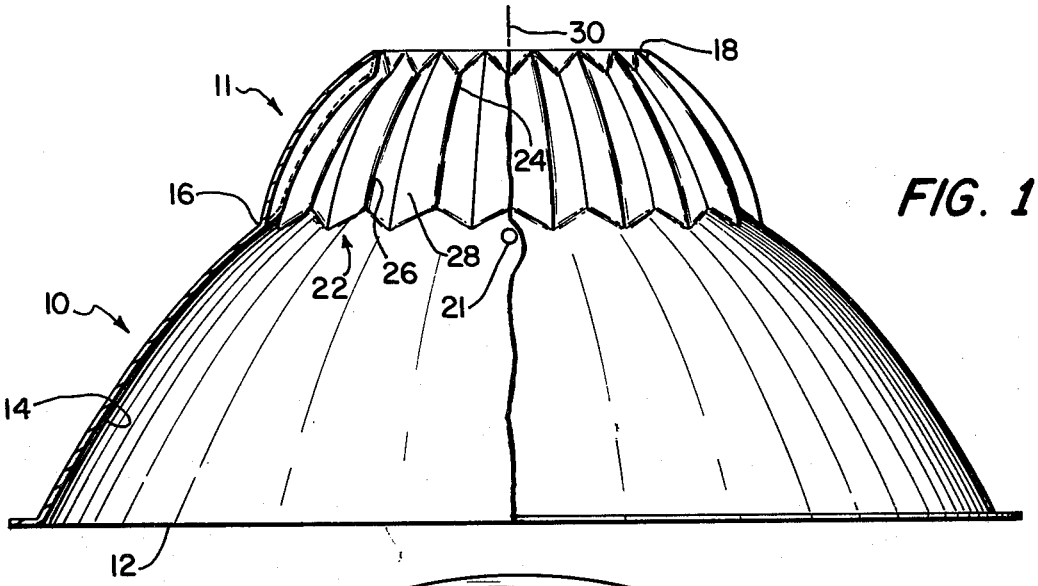
FIG. 1 is a side elevation, in partial section, of a reflector in accordance with the present invention.
Figure 2:
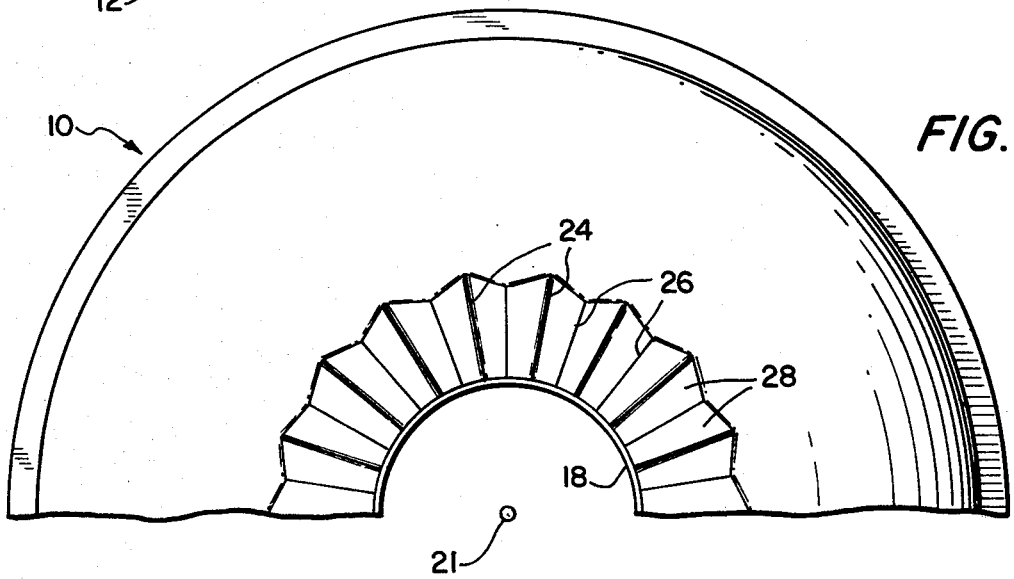
FIG. 2 is an end view of the reflector of FIG. 1.

As shown in FIGS. 1 and 2, a preferred embodiment of a reflector in accordance with the present invention includes a first or front portion indicated generally at 10 and a second or rear portion 11. The larger end of front portion 10 has an open end 12 through which light rays are intended to pass outwardly. Portion 10 has an inner reflective surface 14 which can be either specular or diffusing, depending upon the use to which the reflector will be put. Surface 14 is formed as a surface of parabolic revolution, eliptical revolution, or in accordance with some other surface of revolution developed for a desired distribution of light rays.

Portion 10 decreases in diameter in the direction of portion 11 and can be viewed as ending at a location 16 which is at the larger end of portion 11. The smaller end 18 of portion 11 includes an opening through which a light source and the mounting therefor can extend, the source being schematically indicated by an envelope 20 containing an arc centered at 21. A typical lamp is a low watt, HPS 35-150 watt, medium base lamp such as manufactured by General Electric, Westinghouse, Sylvania and others. It will be observed that the plane containing location 16, which is the junction of portions 10 and 11, is offset from point 21 in the direction away from opening 12.

The rear section 11 is formed with an interior surface indicated generally at 22 which is provided with a plurality of flutes or grooves defined by a plurality of crests 24 and roots 26 with connecting surfaces 28 extending therebetween. Again, surface 22 should be specular to redistribute reflected rays upon the front section from a focal point very close to the centroid of revolution 21.

The flutes lie in planes parallel to the central axis 30 of the reflector, which passes through point 21, and are therefore parallel to the long axis of the discharge lamp mounted therein. Each of the crests of the flutes in portion 11 lies along the arc of a great circle forming a sphere centered on point 21. Similarly, each of the roots 26 lies along the arc of a great circle contained in a sphere concentric with the first sphere containing the crests, but having a larger diameter, this sphere, by definition, also being centered at point 21. In the reflector shown the ratio of diameters of the spheres is about 1.06. As best seen in FIG. 2, the crests and roots are uniformly distributed about point 21, the angular separation between adjacent crests or adjacent roots being approximately 20°, thus permitting 18 complete flutes around the circle. This number is, however, not critical. The crests can be relatively sharp corners, as illustrated for simplicity. However, for ease of manufacture, the crests, and also the roots can be small radius curves, e.g. 0.06 inch radius in a reflector having an open end 12 which is about 6.5 inches in diameter.

The surfaces 28 extending between the crests and roots can be described as linearly formed or planar surfaces defined by an infinite number of arcs of great circles extending between the concentric spheres containing the crests and roots. These surfaces can, however, also be non-linear or non-planar surfaces, each portion of which still is defined by the arc of a great circle, but the separation thereof being non-linear, forming curved surfaces between the adjacent crests and roots.

Figure 3:
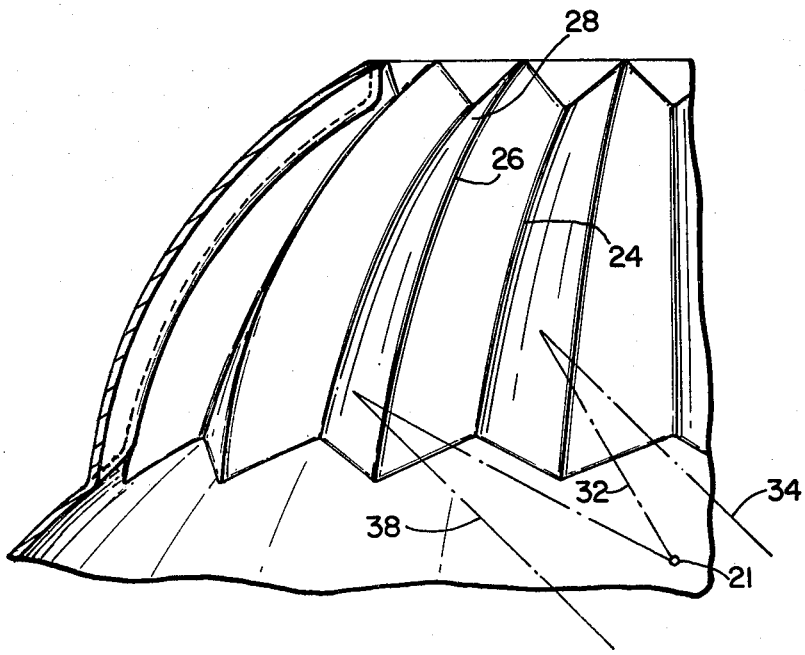
FIG. 3 is an enlarged fragmentary sectional side elevation of the reflector of FIGS. 1 and 2.

FIG. 3 shows, in an enlarged form, a fragment of portion 11, more clearly showing the spherical flutes, and their relationship with the center 21 of the arc forming the light source in a discharge lamp. As will be seen, a "ray" of light 32 impinging upon a surface 28 of the flutes will be reflected in a direction laterally displaced from center 21 as illustrated at 34. Ray 34, upon reaching the reflective surface of portion 10, will further be reflected out of open end 12. Rays striking the oppositely directed surfaces 28 such as illustrated at 36 are, of course, reflected in the opposite direction as illustrated at 38. Thus, reflected light is caused to diverge from the location of the light source, avoiding excessive heating thereof and also avoiding the deleterious effects of such overheating.

For purposes of completeness, following is a table of dimensions showing the radii of portions of the reflector at axial distances from the open end 12, illustrating one form of a reflector in accordance with the invention wherein the portion 10 is parabolic.

| DISTANCE ALONG AXIS 30 FROM OPEN END | RADIUS OF SURFACE 14 |
|---|---|
| 0. | 3.058 |
| .125 | 2.977 |
| .250 | 2.894 |
| .375 | 2.808 |
| .500 | 2.719 |
| .625 | 2.628 |
| .750 | 2.533 |
| .875 | 2.434 |
| 1.000 | 2.332 |
| 1.125 | 2.224 |
| 1.250 | 2.111 |
| 1.375 | 1.992 |
| 1.500 | 1.865 |
| 1.625 | 1.729 |

-continued

| DISTANCE ALONG AXIS 30 FROM OPEN END | RADIUS OF SURFACE 14 |
|---|---|
| 1.750 | 1.581 |

While one advantageous embodiment has been chosen to illustrate the invention it will be understood by those skilled in the art that various changes and modifications can be made therein without departing from the scope of the invention as defined in the appended claims.

What is claimed is:

1. A reflector particularly for use with a high energy efficient light source, the reflector being of the type having an open substantially circular end, a central axis and means at the other, smaller end for mounting a light source in an envelope in the reflector so that the source is on said central axis and is closer to the smaller end that to the larger open end, wherein the reflector comprises a first portion extending from said open end to a location beyond a transverse plane containing the source, said first portion having means defining a substantially smooth reflective interior surface of revolution which is symmetrical about said central axis, the transverse dimensions of said first portion decreasing in the direction of said other end; and a second portion occupying the distance between the smaller end of said first portion and said smaller end of said reflector, said second portion including means defining a plurality of flutes each having a crest lying along an arc of a great circle of a first sphere centered at said source, a root lying along an arc of a great circle of a second sphere centered at said source and having a larger diameter than said first sphere, and a reflective surface extending between said root and crest, said plurality of flutes being uniformly distributed about said central axis;

whereby light rays passing from said source toward said second portion are reflected toward said open end and said first portion along paths laterally offset from said source.

2. A reflector according to claim 1 wherein said interior surface of said first portion is specular.

3. A reflector according to claim 1 wherein said interior surface of said first portion is a diffusing surface.

4. A reflector according to claim 1 wherein each said reflecting surface extending between said root and crest of said second portion is defined by a plurality of great circles of spheres of linearly increasing diameter.

5. A reflector according to claim 1 or 4 wherein the included angle between adjacent crests is about 20°.

6. A reflector according to claim 4 wherein the ratio of the radius of said second sphere to said first sphere is about 1.06.

7. A reflector according to claim 1 wherein said reflective surface of said first portion is a surface of revolution centered on said central axis.

* * * * *